US009502828B2

(12) United States Patent
Schreier et al.

(10) Patent No.: US 9,502,828 B2
(45) Date of Patent: Nov. 22, 2016

(54) INSULATION BODY OF A PLUG-IN CONNECTOR

(71) Applicant: Harting Electronics GmbH, Espelkamp (DE)

(72) Inventors: Stephan Schreier, Rahden (DE); Melanie Genau, Luebbecke (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 0 days.

(21) Appl. No.: 14/406,599

(22) PCT Filed: Apr. 5, 2013

(86) PCT No.: PCT/DE2013/100124

§ 371 (c)(1),
(2) Date: Dec. 9, 2014

(87) PCT Pub. No.: WO2013/189480

PCT Pub. Date: Dec. 27, 2013

(65) Prior Publication Data

US 2015/0162710 A1 Jun. 11, 2015

(30) Foreign Application Priority Data

Jun. 18, 2012 (DE) ..... 10 2012 105 257

(51) Int. Cl.
*H01R 13/625* (2006.01)
*H01R 13/6587* (2011.01)
(Continued)

(52) U.S. Cl.
CPC ..... *H01R 13/6587* (2013.01); *H01R 12/72* (2013.01); *H01R 13/631* (2013.01);
(Continued)

(58) Field of Classification Search
CPC ..... H01R 13/6275; H01R 13/629; H01R 13/20; H01R 13/639
(Continued)

(56) References Cited

U.S. PATENT DOCUMENTS 3,354,424 A * 11/1967 Ruchlemann ..... H01R 31/02 439/743
4,359,258 A * 11/1982 Palecek ..... H01R 12/58 439/682
(Continued)

FOREIGN PATENT DOCUMENTS

DE 9415357 3/1996
DE 202007006357 7/2007
(Continued)

*Primary Examiner* — Abdulla Riyami
*Assistant Examiner* — Thang Nguyen
(74) *Attorney, Agent, or Firm* — Jacobson Holman, PLLC.

(57) ABSTRACT

The invention relates to an insulation body of a plug-in connector that consists of a plug body (10), in which contact elements (11) are provided, and which consists of a connection body (20), which in turn has connection elements (21) that can be electrically connected to conductor tracks of a circuit board and/or to individual wires of a multi-wired cable to be connected, wherein the plug body (10) and the connection body (20) can be mated together, as a result of which the contact elements (11) can be electrically contacted with the connection elements (21) of the connection body (20).

6 Claims, 2 Drawing Sheets

(51) Int. Cl.

| | |
|---|---|
| ***H01R 13/6585*** | (2011.01) |
| ***H01R 31/06*** | (2006.01) |
| ***H01R 12/72*** | (2011.01) |
| ***H01R 13/631*** | (2006.01) |
| *H01R 12/71* | (2011.01) |
| *H01R 13/6583* | (2011.01) |
| *H01R 107/00* | (2006.01) |

(52) U.S. Cl.
CPC ..... *H01R 13/6585* (2013.01); *H01R 31/06* (2013.01); *H01R 12/712* (2013.01); *H01R 13/6583* (2013.01); *H01R 2107/00* (2013.01)

(58) Field of Classification Search
USPC ..... 439/345, 346
See application file for complete search history.

(56) References Cited

U.S. PATENT DOCUMENTS

| | | | | | |
|---|---|---|---|---|---|
| 4,713,021 | A * | 12/1987 | Kobler | H01R 13/5205 | 439/272 |
| 4,758,174 | A * | 7/1988 | Michaels | H01R 13/5219 | 439/281 |
| 5,045,090 | A | 9/1991 | Pohl | | |
| 5,591,041 | A * | 1/1997 | Cecil, Jr. | H01R 13/506 | 439/352 |
| 6,045,416 | A * | 4/2000 | Sinclair | H01R 13/04 | 439/72 |
| 7,316,584 | B2 * | 1/2008 | Mackillop | H01R 13/6477 | 439/607.05 |
| 7,670,180 | B2 * | 3/2010 | Gerard | H01R 13/6599 | 439/465 |
| 8,764,471 | B2 * | 7/2014 | Dang | H01R 13/6463 | 439/310 |
| 2004/0102060 | A1 | 5/2004 | Schauz et al. | | |
| 2013/0137310 | A1 | 5/2013 | Genau | | |
| 2013/0260596 | A1 * | 10/2013 | Flower | H01R 4/00 | 439/345 |
| 2014/0335717 | A1 | 11/2014 | Finzer | | |
| 2015/0004826 | A1 * | 1/2015 | Starke | H01R 4/64 | 439/345 |

FOREIGN PATENT DOCUMENTS

| | | |
|---|---|---|
| DE | 102006041610 | 5/2008 |
| DE | 20 2009 012 101 | 12/2009 |
| DE | 102010051954 | 2/2012 |
| JP | 05-200774 | 8/1993 |
| JP | 06-154942 | 6/1994 |
| JP | 07-155735 | 6/1995 |
| JP | 3015144 | 6/1995 |
| JP | 08-091975 | 4/1996 |
| JP | 09-185970 | 7/1997 |
| JP | 2000-513137 | 10/2000 |
| JP | 2001-266982 | 9/2001 |
| JP | 2004-074101 | 3/2004 |
| JP | 2005-021888 | 1/2005 |
| JP | 2007-307475 | 11/2007 |
| JP | 2008541354 | 11/2008 |
| WO | WO 98/53526 | 11/1998 |

* cited by examiner

1

INSULATION BODY OF A PLUG-IN CONNECTOR

BACKGROUND OF THE INVENTION

1. Technical Field

The invention relates to an insulation body of a plug-in connector. An insulation body is inserted into a chamber of a plug-in connector housing that is provided for this purpose.

2. Background Art

As a rule, insulation bodies include receptacles for contact elements, which the wires of a cable to be connected to the plug-in connector are connected to. Alternatively, the contact elements may also be electrically contacted with the conductor tracks of a circuit board.

DE 102010051954 B3 shows a circular plug-in connector, the contact members of which penetrate the plug-in connector over its full length, in order to form on the one hand the plug face and on the other hand the connection region of the plug-in connector. Such contact members are frequently bent and cannot be simply inserted into the insulation body. Therefore, the insulation body often has to be designed to be pivotable, foldable or in multiple parts.

In data transmission technology, insulation bodies with so-called shielding elements are used. The shielding elements are used to shield at least two wires of the cable to be connected—and/or the associated contact elements—electromagnetically against each other.

Such insulation bodies are needed in order to provide multi-pole connectors for analogue or digital data transmission, which can be used in shielded implementations at frequencies of up to 600 MHz or even higher.

In an insulation body of DE 102010051954 B3, the shielding cross is designed as a single metallic component that has to be inserted into the plug-in connector. The insulation body has to present such an opening.

BRIEF SUMMARY OF THE INVENTION

It is the object of the invention to propose an insulation body that can be manufactured in a more cost-effective and simple manner than the variants mentioned above.

The insulation body proposed here consists of a plug body and a connection body. In the plug body, the contact elements are arranged that form the so-called plug face of the plug-in connector.

In the connection body, connection elements are provided. The connection elements have a connection region that can be electrically contacted for example by conductor tracks of a circuit board. Preferably, the connection region is then formed as a so-called soldering foot 21*a* (also referred to as solder pin). However, here too, the SMD (surface mounted device) or pin-in-hole technology can be used. It is also possible to provide an electric contact of the connection region with a conductor of a cable to be connected.

In known insulation bodies, the plug body and the connection body are formed together in one component. In the case of the insulation body according to the invention, the plug body and the connection body are separate components. When these components are mated with each other, the contact elements of the plug body are electrically contacted with the connection elements of the connection body.

In order to allow the plug body and the connection body to be latched together, suitable latching means are preferably provided. These latching means preferably allow a reversible connection of the plug body and the connection body.

By virtue of the plug body and the connection body being in two parts it becomes possible to reversibly connect the same plug body with different connection bodies. As a result, a plug-in connector having the same plug face can be conditioned on the one hand for a circuit board connection and on the other hand for a cable connection. The connection body can be optimally adapted to the respective area of use and can be implemented for example in an angled or in a straight manner. As a result of the modularity of the connection region as described above, the plug-in connector can be used in a versatile manner.

It may also be advantageous to design the plug body and the connection body so that they can be irreversibly latched together by means of latching means. This is advantageous in order to avoid multiple plugging and thus an increase of the transition resistance.

Preferably, the contact elements are formed to be elongate and are arranged parallel to each other in the plug body. One end of the contact member is provided in the plug region of the plug-in connector and can be connected to a contact element of a counter-plug and/or a socket. The other end of the contact element forms a contact region, which a connection element of the connection body can be electrically contacted with.

Preferably, the connection element is designed as a conductor track that offers a connection region for the contact elements thereof in the direction of the plug body. In the circuit board or cable connection direction, a connection region for a conductor track of a circuit board and/or a wire of a cable to be connected is located on the conductor track.

Advantageously, the conductor track of the connection member is produced using MID (molded interconnect device) technology. MID technology is sufficiently described in DE 102006041610 B3. As a result, there is no limit to the freedom in designing the conductor tracks. The conductor tracks may be formed in such a way that they are particularly suitable for high frequency data transmission. The end-side connection regions following on from the conductor track (for example on the one side a connection socket for the contact elements and on the other side the soldering feet for the circuit board) may continue to be implemented as a metallic element.

In an advantageous embodiment of the invention, the plug body has a shielding element that shields at least two contact elements electromagnetically against each other. As a result, a so-called crosstalk of the signals that are transmitted via the contact elements is prevented.

In a further advantageous embodiment of the invention, the connection body is also provided with a shielding element that shields at least two connection elements electromagnetically against each other.

In a particularly preferred embodiment of the invention, the plug body and the connection body each have a shielding element. In the mated condition of the plug body and the connection body, the shielding elements are in electrical contact with each other. Alternatively, the shielding elements overlap in an axial orientation of the insulation body. As a result of the above measures, the signal integrity of the finished plug-in connector is markedly improved.

Advantageously, the above-described shielding elements are produced using MID technology. As a result, the plug body and the connection body may be produced in one piece in a compact and cost-effective manner.

BRIEF DESCRIPTION OF THE DRAWINGS

An embodiment example of the invention is shown in the drawings and will be explained in more detail below, wherein.

DETAILED DESCRIPTION OF THE INVENTION

Figure 1:
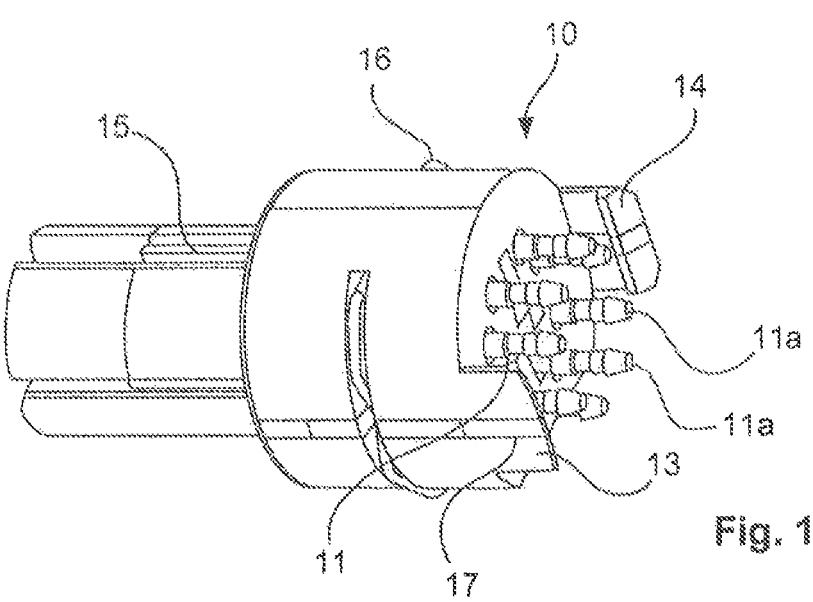
FIG. 1 shows a perspective view of a plug body.
Figure 2:
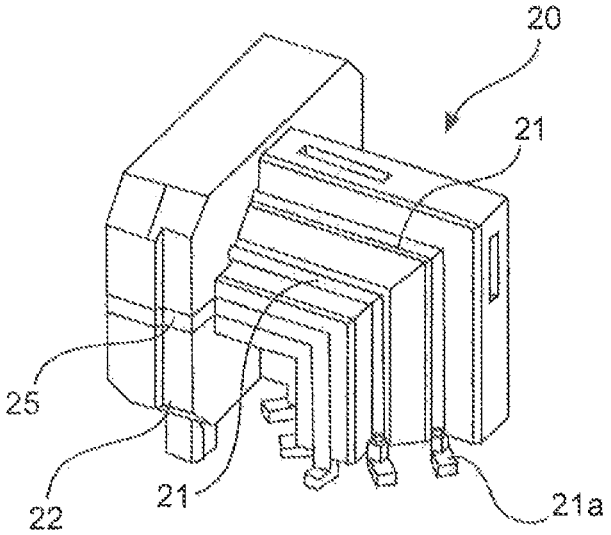
FIG. 2 shows a perspective view of a connection body.
Figure 3:
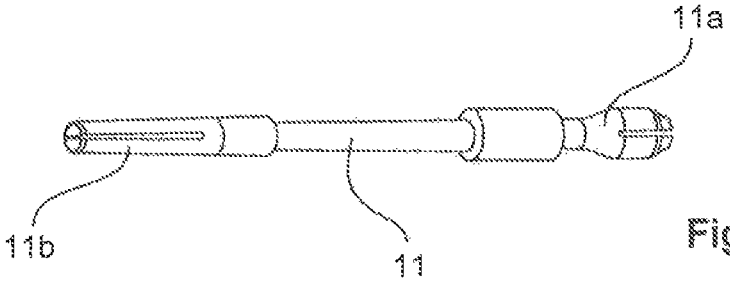
FIG. 3 shows a perspective view of a contact element.
Figure 4:
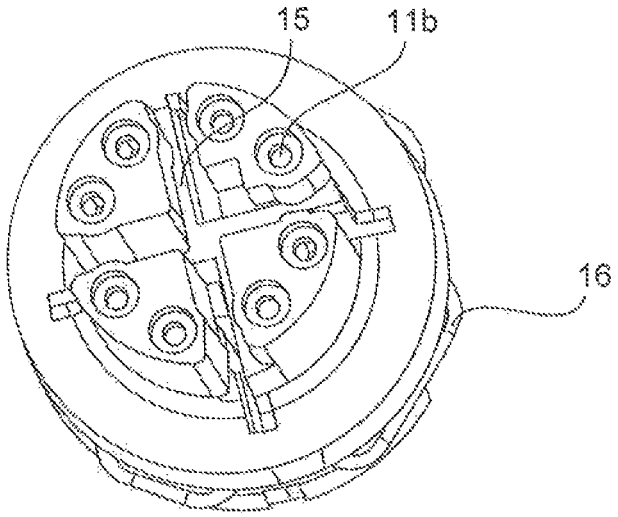
FIG. 4 shows a perspective top view of the plug face of the plug body.
Figure 5:
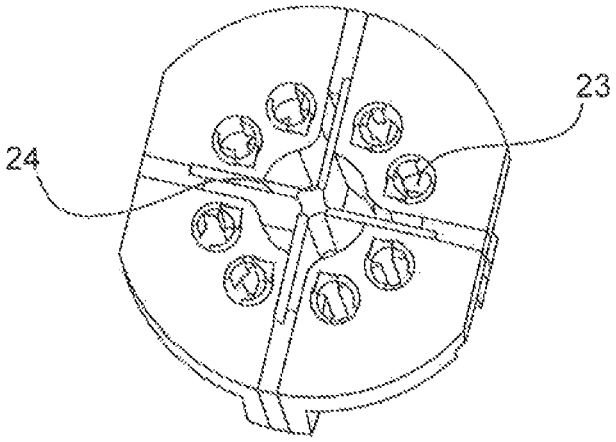
FIG. 5 shows a further perspective view of the connection body.

FIG. 1 shows a perspective view of a plug body 10 and FIG. 2 shows a perspective view of the associated connection body 20. The plug body 10 and the connection body 20 together form an insulation body 1 for a plug-in connector. In order to lock the plug body 10 and the connection body 20 together, latching arms 13 are provided on the plug body 10, the latching noses 14 of which latching arms engage on an undercut 22 of the connection body 20.

In the plug body 10, contact elements 11 are provided. One end of the contact element 11 can be electrically contacted with the associated connection elements 21 of the connection body 20. To this end, the frustoconical portion 11*a* is inserted into a contact opening 23 of the connection body 20. The contact opening 23 comprises a conducting material, which in turn is conductively connected to a conductor track 21. The other and is implemented as a bifurcated contact terminal 11*b* and is provided for contacting contact elements of a counter-plug and/or a socket (not shown). In other embodiments, a simple contact pin instead of the bifurcated contact terminal may be provided in the plug face.

In the plug body 10, a cruciform shielding element 15 is provided, which electromagnetically shields in each case two contact elements 11*b* in a pairwise manner relative to the other contact elements 11*b* arranged in a pairwise manner. A metallic shielding spring 16 is in conductive contact with the shielding element 15 and the plug-in connector housing (not shown).

In the connection body 20, too, a cruciform shielding element 24 is provided, which in each case shields two connection elements 21 in a pairwise manner electromagnetically against other connection element pairs.

A conductor track 17, which is connected to the shielding element 15 in a conductive manner, is attached to the latching arm 13 of the plug body 10. Also in the region of the undercut 22 of the connection body 20, a conductor track 25 is applied, which is connected to the shielding element 24. Via the conductor tracks 17, 25, the shielding elements 15, 24 are also contacted in a conductive manner. The conductor tracks 17, 25 are here produced using MID technology.

LIST OF REFERENCE NUMERALS

1 Insulation body
10 Plug body
Contact element
11*a* Frustoconical portion
11*b* Bifurcated contact terminal
13 Latching arm
14 Latching nose
15 Shielding element
16 Shielding spring
17 Conductor track
20 Connection body
21 Connection element
22 Undercut
23 Contact opening
24 Shielding element
25 Conductor track

The invention claimed is:

1. An insulation body of a plug-in connector, which comprises a plug body (10) having elongated contact members (11) extending therethrough, each of said contact members forming a frustoconical portion (11*a*) at one end, and a bifurcated contact terminal (11*b*) at an opposite end, said insulation body further comprising a separate connection body (20) having contact openings (23) formed of conducting material that connects with connection elements (21) on the connection body that can be electrically connected to conductor tracks of a circuit board and/or to individual wires of a multi-wired cable to be connected, wherein the plug body (10) and the connection body (20) are separate components that can be mated and latched together such that the frustoconical portions of the contact members are inserted in the contact openings to enable the contact members (11) to be in electrical contact with the connection elements (21) of the connection body (20), and wherein the bifurcated contact terminals are exposed for connection to a counter-plug or socket, wherein said plug body (10) includes a shielding element (15) for electromagnetically shielding at least two of said elongated contact members (11), said plug body (10) further including a latching arm (13) having a latching nose (14) at a free end of said latching arm, said latching arm including a conductive track (17) electrically connected to said shielding element (15), wherein said connection body (20) includes a shielding element (24) for electromagnetically shielding at least two of said connection elements (21), said connection body (20) further including an undercut (22) to receive said latching nose of said plug body to enable the plug body and connection body to be latched together, wherein in the region of said undercut (22), the connection body (20) includes a conductive track (25) electrically connected to said shielding element (24), wherein the shielding elements (15, 24) are electrically connected to each other through the conductive tracks (17, 25) when the plug body (10) and the connection body (20) are latched together.

2. The insulation body of a plug-in connector as claimed in claim 1, characterised in that the shielding elements (15, 24) are produced using MID technology.

3. The insulation body of a plug-in connector as claimed in claim 1, characterised in that the shielding elements (15, 24) overlap when the plug body and connection body are latched together.

4. The insulation body of a plug-in connector as claimed in claim 1, characterised in that the connection members (21) are at least partially realised using MID technology.

5. The insulation body of a plug-in connector as claimed in claim 1, characterised in that the connection body (20) has an angled shape.

6. The insulation body of a plug-in connector as claimed in claim 1, characterised in that the connection body (20) has a straight shape.

* * * * *